US005475171A

United States Patent [19]

McMahon et al.

[11] Patent Number: 5,475,171

[45] Date of Patent: Dec. 12, 1995

[54] TWO-STROKE ENGINE OILS

[75] Inventors: John McMahon, Linlithgow; John D. Fotheringham, Stirlingshire, both of Scotland

[73] Assignee: BP Chemicals Limited, London, England

[21] Appl. No.: 285,795

[22] Filed: Aug. 4, 1994

[30] Foreign Application Priority Data

Aug. 20, 1993 [GB] United Kingdom ..... 9317323

[51] Int. Cl.[6] ..... C10M 111/04

[52] U.S. Cl. ..... 585/2; 585/10; 585/14; 44/300

[58] Field of Search ..... 44/459, 300; 252/43; 585/2, 10, 14, 525

[56] References Cited

U.S. PATENT DOCUMENTS

| | | | |
|---|---|---|---|
| 2,957,930 | 10/1960 | Jackson . | |
| 3,753,905 | 8/1973 | Souillard et al. | 252/33.4 |
| 4,605,808 | 8/1986 | Samson | 585/525 |
| 5,049,291 | 9/1991 | Miyaji et al. | 252/33 |
| 5,286,823 | 2/1994 | Rath | 526/237 |
| 5,321,172 | 6/1994 | Alexander et al. | 585/2 |
| 5,330,667 | 7/1994 | Tiffany et al. | 252/49.6 |

FOREIGN PATENT DOCUMENTS

| | | |
|---|---|---|
| 0134014 | 3/1985 | European Pat. Off. . |
| 0145235 | 6/1985 | European Pat. Off. . |
| 0361180 | 4/1990 | European Pat. Off. . |
| 0594319 | 4/1994 | European Pat. Off. . |
| 2657088 | 7/1991 | France . |
| 1162172 | 8/1969 | United Kingdom . |
| 1287579 | 8/1972 | United Kingdom . |
| 1340804 | 12/1973 | United Kingdom . |
| 1391708 | 4/1975 | United Kingdom . |

OTHER PUBLICATIONS

Literatuuroverzicht T.D.C.K.: Chemische technologie, vol. 7 1972 w(T) o.g] which is an abstract of Souillard, G. J., Van Quaethoven F., Dyer, R. B., Society of Automotive Engineers, National Farm, Construction & Industrial Machinery Meeting, Milwaukee, Wisc., USA., dd. 13–16 Sep. 1971., nr. 710730, 9 pag., 4 fig., 8 tab., 14 ref.

*Primary Examiner*—Stephen Kalafut
*Assistant Examiner*—Cephia D. Toomer
*Attorney, Agent, or Firm*—Brooks Haidt Haffner & Delahunty

[57] ABSTRACT

This invention relates to a two-stroke engine oil which comprises polybutene base oils which are either very low in or are substantially free of n-butenes in the polymer backbone. The absence of n-butenes in the polybutenes significantly reduces smoke emission in exhaust gases generated by the use of the engine oil. Polybutenes such as ULTRAVIS® which are substantially free of chlorine and have a high degree of terminal unsaturation are particularly preferred.

9 Claims, No Drawings

TWO-STROKE ENGINE OILS

The present invention relates to two-stroke oils which comprise polybutene base oils which are either very low in or substantially free of n-butenes in the polymer backbone.

Two-stroke engine oils are usually lubricating compositions which are used in admixture with a fuel and lubricate the moving parts of two-stroke engines. Such engines may include outboard engines with a power higher than 50 hp and rising upto 100 hp, air-cooled engines which may not only be used in motorcycles but also, for example, in chain-saws, skidoos or snowmobiles. A feature of these engines is their high speed of rotation and as a result they are hotter than engines used hitherto.

Initially, the principle requirement of a lubricant for such an engine was for it to be able to form a stable and continuous film of oil on the affected parts not only at low temperatures to facilitate start-up but also at relatively higher operating temperatures in order to avoid fouling by the formation of deposits on engine parts which in turn could reduce performance of the engine or cause damage to the affected parts.

More recently, the focus has been on oils which are environmentally friendly, ie the exhaust gases resulting from the combustion of the fuel and lubricant are clean, have minimum odour, do not give out visible smoke and, in addition, have reduced oil/fuel ratios.

Polybutenes have been used for many years as components in two-stroke oils where, they give advantages over mineral oils in that they emit low visible exhaust smoke and result in low carbon deposit formation in the engine exhaust system. GB-A-1287579 (The British Petroleum Co Ltd) applied for in 1968 describes, for instance, the use of polyisobutylene polymer as a lubricant. However, typically, this specification does not give any method of manufacture of the poly(iso)butene nor indeed the source of C4 feedstock used as raw-material to produce these polyisobutylenes. It is well known that poly(iso)butenes used hitherto have invariably been produced from a mixture of butenes including n-butenes and isobutene e.g. from a feedstock which is primarily butadiene raffinate or a crude C4 stream from a fluid catalytic cracking (FCC) process and contains from 20–40% n-butenes. That was the case around the time of application of GB-A-1287579 as is apparent from GB-A-1340804 (Labofina SA, applied for in 1972) which describes the polymers as being manufactured from fractions containing hydrocarbons with 4 carbon atoms and the polymers produced therefrom are said to contain polybutylene and polyisobutylene in varying proportions, generally from 5–70% of polyisobutylene and from 95–30% of poly-n-butylenes.

It has now been found that polybutenes which contain much lower levels of or are substantially free from n-butenes in the polymer backbone give superior performance not only in reducing visible smoke in the exhaust gases from a two-stroke engines but also in respect of low carbon deposit formation.

Accordingly, the present invention is a two-stroke engine oil comprising a polybutene polymer or mixtures of polymers of molecular weight (Mn) from 300–2000 characterised in that the proportion of n-butenes in the polymer backbone, as defined by the ratio of the infra-red absorbance of the —$CH_2CH_2$— n-butene units in the polymer at 740 $cm^{-1}$ to that of the C—H overtone absorbance between 4315 and 4345 $cm^{-1}$, usually 4335 $cm^{-1}$ is <0.2 for polybutenes with a value of Mn which is equal to or <700, and <0.12 for polybutenes with Mn=700.

The definition for the proportion of n-butene (hereafter "NB") in the polymer backbone has been defined by the infra-red absorbance technique because this is a difficult concept to determine quantitatively. In order to avoid these problems it was decided to develop an indigeneous method by comparing the corresponding infrared absorbances (at specified frequencies) of commercially available polybutenes and the PIB's low in n-butene content now used. This method uses the 740 $cm^{-1}$ —$CH_2CH_2$— absorption as an indication of the relative n-butene content in the polymer backbone. It was used with a Nicolet 740 FTIR spectrometer fitted with DTGS detector and CsI beam splitter. The spectrometer had KBr windows with 0.2 mm Teflon® spacer with small section cut out and a suitable cell holder. A spectrum of the sample was obtained using 4 $cm^{-1}$ resolution. The absorbance peak height of the 740 $cm^{-1}$ band between the baseline limits of the two minima in the 800 and 700 $cm^{-1}$ regions was then measured. The 4335 $cm^{-1}$ band was also characterised by measuring its absorbance peak height between the baseline limits 4750 and 3650 $cm^{-1}$. The relative n-butene content was calculated as follows:

$$\frac{\text{Absorbance at 740 cm}^{-1}}{\text{Absorbance at 4335 cm}^{-1}}$$

This is the method used in the calculations set out below.

For this exercise, the polybutene (PIB) which had a relatively low n-butene content or was substantially free therefrom was made by the process claimed and described in our published EP-A-0 145 235, ie a pre-formed boron trifluoride-ethanol complex is used as catalyst for the polymerisation of isobutene and the method described therein is incorporated herein by reference. This process resulted in a polymer which was not only low in n-butene content but was also substantially free of chlorine. The product of such a process is the ULTRAVIS® grades of polybutene (commercially available from BP Chemicals Ltd) used in the Examples. Polybutenes which are low in n-butene content or are substantially free therefrom can also be made using other processes by careful choice of feedstock and/or process conditions. For comparison purposes, the polybutene with a relatively higher n-butene content used was the commercially available HYVIS® grades (also available from BP Chemicals Ltd).

It can be seen from the tabulated data below that there is indeed a significant difference in the respective absorbance ratios:

TABLE 1

IR Absorbance Ratio of Polymers at 740 cm-1(NB)/4335 cm-1(PIB)

| Polymer | Viscosity (100° C.) | Mn | NB/PIB Ratio |
|---|---|---|---|
| HYVIS ®5 | 104 | 764 | 0.278 |
| PNB 07* | 14.7 | 540 | 1.120 |
| HYVIS ®PB25 | 25.0 | 530 | 0.32 |
| ULTRAVIS ®5 | 100 | 762 | 0.106 |
| ULTRAVIS ®3 | 60 | 645 | 0.147 |
| HYVIS ®10 | 223 | 962 | 0.203 |
| ULTRAVIS ®10 | 225 | 966 | 0.049 |
| ULTRAVIS ®PB25 | 25.3 | 510 | 0.150 |
| Pure PIB 5** | 101 | 775 | 0.0 |

*PNB 07 is an experimental polymer manufactured from a C4 stream rich in n-butene and low in isobutene.

**Designated hereafter as PPIB 5 which is a polymer manufactured from a C4 stream rich in isobutene and is essentially free from n-butene.

From this Table 1 it is apparent that most conventional grades of polybutene polymers have this absorbance ratio well above 0.2 at molecular weights (Mn) below 700 and well above 0.12 at Mn >700.

A further feature of the present invention is that the PIB polymers now used can also be substantially free of chlorine. The presence of chlorine or derivatives thereof in exhaust gases are undesirable and hence the use of chlorine-free PIB's is most desirable. It has been found that whereas two-stroke engine oils formulated from e.g. HYVIS®5 and HYVIS®10 respectively have ~97 and ~45 ppm chlorine, those produced from ULTRAVIS®5 and ULTRAVIS®10 each has <5 ppm of chlorine. This is due to the fact that no chlorine containing compounds are used in the production of ULTRAVIS® Grades of polybutenes. Thus, the level of chlorine in the latter is below the detectable levels and can be considered to be substantially free of chlorine.

Thus, according to a further embodiment, the present invention is a two-stroke engine oil comprising a polybutene polymer or mixture of polymers of a number average molecular weight (Mn) from 300–2000 characterised in that the proportion of n-butene in the polymer backbone, as defined by the ratio of the infra-red absorbance of the polymer at 740 $cm^{-1}$ to that at 4335 $cm^{-1}$, is <0.2 at a value of Mn of the polymer equal to or <700, and <0.12 at Mn of the polymer >700, and said lubricating oil is substantially free of chlorine.

The PIB's used in the two-stroke engine oils of the present invention suitably have a viscosity in the range of 2 to 670 cSt for Mn ranging from 310–1300, preferably from 3–250 cSt and are most suited for the production of low smoke oils.

The amount of PIB present in the two-stroke engine oil formulation is suitably in the range from 15–80% w/w, more typically from 25–50% w/w. The other component usually present in such two-stroke oils is a mineral oil and is used in levels ranging from 20– 70% w/w.

To improve the detergency of such two-stroke engine oil formulations, it is usual to add low ash additives and a diluent such as kerosine to improve the handling of the formulation and to enhance the miscibility thereof with the fuel.

Such two-stroke engine oil formulations may also contain synthetic esters, poly-α-olefins and alkylated benzenes to produce high performance products.

The standard test procedures used for evaluation are those developed by the Japanese Automotive Standards Organisation (JASO) to classify the performance of two-stroke oils. One of these tests (M342) involves a procedure to measure the formation of exhaust smoke during part of a test cycle. The result is expressed as a Smoke Index and is internally referenced against a standard two-stroke oil ranked with a Smoke Index of 100. The higher the Smoke Index the greater is the reduction in smoke emission. The test uses a 70 cc, Suzuki Generator SX 800 R. The results of the smoke test of the oils are shown in Table 2 below.

The present invention is further illustrated with reference to the following Examples:

EXAMPLE 1

ULTRAVIS®5 polybutene (38% w/w) was blended with Solvent Neutral 500 mineral oil (36% w/w) and additives package ADX 3110 (8% w/w, ex BP Chemicals Additives Ltd) at 60° C. in a mixer. Kerosine (18% w/w) was then added and the oil characteristics of the blend was measured.

In a comparative experiment not according to the invention, the same amount of materials were mixed together except that ULTRAVIS®5 polybutene was replaced by HYVIS®5 polybutene.

A JASO smoke test of the two formulations above revealed that ULTRAVIS®5 polybutene of low n-butene content in the polymer backbone provided the greater reduction in smoke emission than the corresponding formulation with HYVIS®5. The results of the tests are tabulated in Table 3 below:

EXAMPLE 2

The process of Example 1 was repeated except that the Solvent Neutral mineral oil used was a blend of SN500 and SN150 (19/81 w/w). Also the polybutenes used were ULTRAVIS®10 (according to the invention) and HYVIS®10 (comparative test, not according to the invention). The respective quantites of each of the components used was not strictly identical since such a strict and precise measurement of the respective components is not practicable and is not essential to gauge performance. The specific compositions used are tabulated in Table 2 below.

The JASO smoke test revealed that the formulation containing ULTRAVIS®10 polybutene of low n-butene content in the polymer backbone provided a greater reduction in the smoke emission than the corresponding formulation containing HYVIS®10 with a relatively higher n-butene content. The results of this smoke test are tabulated in Table 3 below:

TABLE 2

TWO STROKE OIL FORMULATION

| Component | HYVIS ®10 | ULTRAVIS ®10 |
|---|---|---|
| Polybutene | 30.6 | 30.0 |
| Min. Oil SN500/SN150 | 42.8 | 44.0 |
| Additives ADX 3110 | 8.2 | 8.0 |
| Kerosine Diluent | 18.4 | 18.0 |

TABLE 3

SMOKE TEST (JASO)

| Polymer | NB/PIB ratio* | PIB content of lube | Smoke Index |
|---|---|---|---|
| ULTRAVIS ®5 | 0.106 | 38.0 | 99 |
| HYVIS ®5 | 0.278 | 38.0 | 90 |
| ULTRAVIS ®10 | 0.049 | 30.0 | 81 |
| HYVIS ®10 | 0.203 | 30.6 | 74 |

*Ratio of absorbance at 740 $cm^{-1}$ to absorbance at 4335 $cm^{-1}$.

EXAMPLE 3

ULTRAVIS®PB25 polybutene (36.6% w/w) was blended with solvent neutral 500 mineral oil (37.3% w/w) and additives package ADX 3110 (8.1% w/w, ex BP Chemicals Additives Ltd) at 60° C. in a mixer. Kerosine (18.6% w/w) was then added and the oil characteristics of the blend determined.

In a comparative test (not according to the invention) the same amount of materials were mixed together except that ULTRAVIS®PB25 polybutene was replaced with HYVIS®PB25 polybutene.

The components present in these two formulations are shown in Table 4 below:

TABLE 4

| TWO STROKE OIL FORMULATION | | |
|---|---|---|
| Component | HYVIS ®PB25 | ULTRAVIS ®PB25 |
| Polybutene | 36.6 | 36.6 |
| Min. Oil SN500/SN150 | 37.3 | 37.3 |
| Additives ADX 3110 | 8.1 | 8.1 |
| Kerosine Diluent | 18.0 | 18.0 |

These formulations were subjected to a JASO Smoke Test as previously and the results obtained are shown in Table 5 below:

TABLE 5

| SMOKE TEST (JASO) | | | |
|---|---|---|---|
| Polymer | NB/PIB ratio* | PIB content of lube | Smoke Index |
| ULTRAVIS ®PB25 | 0.150 | 36.6 | 97 |
| HYVIS ®PB25 | 0.320 | 36.6 | 95 |

*Ratio of absorbance at 740 $cm^{-1}$ to absorbance at 4335 $cm^{-1}$.

Thus, the JASO Smoke Test on both of these formulations revealed that the formulation containing ULTRAVIS®PB25 polybutenes of low n-butene content in the polymer backbone provided a greater reduction in smoke emission than the corresponding formulation containing HYVIS®PB25 polybutene with a relatively higher n-butene content in the polymer backbone.

EXAMPLE 4

The process of Example 1 was repeated except that the polybutenes used were PPIB 5 (according to the invention) and HYVIS®5 (comparative test, not according to the invention) respectively. The respective quantities of each of the components used in the formulation was not strictly identical since such strict and precise measurements of the respective components is not essential to guage performance. The components in these formulations are shown in Table 6 below:

TABLE 6

| TWO STROKE OIL FORMULATION | | |
|---|---|---|
| Component | PPIB 5 | HYVIS ®5 |
| Polybutene | 38.0 | 38.0 |
| Min. Oil SN500/SN150 | 35.9 | 36.0 |
| Additives ADX 3110 | 8.0 | 8.0 |
| Kerosine Diluent | 18.1 | 18.0 |

A JASO Smoke Test was carried out on these formulations as previously and the results achieved are shown in Table 7 below:

TABLE 7

| SMOKE TEST (JASO) | | | |
|---|---|---|---|
| Polymer | NB/PIB ratio* | PIB content of lube | Smoke Index |
| PPIB 5 | 0.0 | 38.0 | 95 |
| HYVIS ®5 | 0.278 | 38.0 | 90 |

Thus, the JASO Smoke Test revealed that the formulation containing PPIB 5 polybutene substantially free of n-butene content in the polymer backbone provided a greater reduction in the smoke emission than the corresponding formulation containing HYVIS®5 polybutene with a relatively higher n-butene content in the polymer backbone.

We claim:

1. A two-stroke engine oil comprising a mineral oil and a polybutene polymer or mixtures of polymers of molecular weight (Mn) from 300–2000 characterised in that the proportion of n-butenes in the polymer backbone, as defined by the ratio of the infra-red absorbance of the —$CH_2CH_2$— n-butene units in the polymer at 740 $cm^{-1}$ to that of the CH—H overtone absorbance between 4315 and 4345 $cm^{-1}$, is <0.2 for polybutenes with a value of Mn equal to or <700, and <0.12 for polybutenes with Mn>700.

2. A two-stroke engine oil according to claim 1 comprising a polybutene polymer or mixture of polymers of a number average molecular weight (Mn) from 300–2000 characterised in that the proportion of n-butene in the polymer backbone, as defined by the ratio of the infra-red absorbance of the polymer at 740 $cm^{-1}$ to that at 4335 $cm^{-1}$, is <0.2 at Mn of the polymer equal to or <700, and <0.12 at Mn of the polymer >700.

3. A two-stroke engine oil according to claim 1 wherein the polybutene polymer is substantially free of chlorine.

4. A two-stroke engine oil according to claim 3 wherein the polybutene polymer is such that more than 60% of the unsaturated linkages in the polymer are of the vinylidene ( . . . =$CH_2$) type.

5. A two-stroke engine oil according to claim 1 wherein the polybutenes have a viscosity in the range of 2 to 670 cSt for Mn ranging from 310–1300.

6. A two-stroke engine oil according to claim 1 wherein the amount of polybutene present in said oil is in the range from 15–80% by weight.

7. A two-stroke engine oil according to claim 1 wherein said mineral oil is in levels ranging from 20–70% by weight.

8. A two-stroke engine oil according to claim 1 wherein said oil contains low ash additives and a hydrocarbon diluent to improve the handling of the oil and to enhance miscibility thereof with fuel.

9. A two-stroke engine oil according to claim 1 wherein said oil contains synthetic esters, poly-α-olefins and alkylated benzenes to produce high performance products.

* * * * *

UNITED STATES PATENT AND TRADEMARK OFFICE

CERTIFICATE OF CORRECTION

PATENT NO. : 5,475,171

DATED : December 12, 1995

INVENTOR(S) : JOHN McMAHON and JOHN D. POTHERINGHAM

It is certified that error appears in the above-indentified patent and that said Letters Patent is hereby corrected as shown below:

Column 6,
Claim 1, line 23, change "CH-H" to --C-H--.

Signed and Sealed this

Ninth Day of April, 1996

Bruce Lehman

*Attest:*

BRUCE LEHMAN

*Attesting Officer*

*Commissioner of Patents and Trademarks*